US011154969B2

(12) United States Patent
Kukucka et al.

(10) Patent No.: US 11,154,969 B2
(45) Date of Patent: Oct. 26, 2021

(54) FASTENER EXTRACTOR DEVICE

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 16/255,341

(22) Filed: Jan. 23, 2019

(65) Prior Publication Data

US 2019/0152033 A1 May 23, 2019

Related U.S. Application Data

(63) Continuation-in-part of application No. 16/107,842, filed on Aug. 21, 2018, and a continuation-in-part of
(Continued)

(51) Int. Cl.
*B25B 27/18* (2006.01)
*B25B 23/08* (2006.01)
(Continued)

(52) U.S. Cl.
CPC ..... *B25B 27/18* (2013.01); *B25B 13/04* (2013.01); *B25B 13/065* (2013.01);
(Continued)

(58) Field of Classification Search
CPC ..... B25B 13/04; B25B 13/063; B25B 15/001; B25B 15/008; B25B 23/08; B25B 27/18
(Continued)

(56) References Cited

U.S. PATENT DOCUMENTS 1,549,041 A * 8/1925 Berg ..... B25B 23/103 81/53.2
1,798,944 A * 3/1931 Jackman ..... B25B 27/18 81/53.2
(Continued)

FOREIGN PATENT DOCUMENTS

AU 201612229 4/2016
AU 201612720 6/2016
(Continued)

*Primary Examiner* — Michael D Jennings
*Assistant Examiner* — Marcel T Dion

(57) ABSTRACT

A fastener extractor device for removing seized fasteners and aiding in disengaging the extractor device from said seized fastener afterwards. The extractor device includes a shank body, a drive head, a torque-tool body, a tubular sleeve, an external thread, and an internal thread. The torque-tool body includes a plurality of laterally-bracing sidewalls and an at least one engagement feature. The engagement feature is integrated into a specific sidewall to bite into a sized fastener. The drive head is terminally and concentrically connected to the shank body to receive an external torque tool. The torque-tool body is terminally and concentrically connected to the shank body, opposite the drive head. The tubular sleeve is slidably engaged along the shank body through the internal thread and the external thread to physically disengaged the torque-tool body from a seized fastener.

12 Claims, 8 Drawing Sheets

Related U.S. Application Data application No. PCT/IB2017/054379, filed on Jul. 19, 2017, and a continuation-in-part of application No. 15/601,864, filed on May 22, 2017, which is a continuation-in-part of application No. PCT/IB2017/052453, filed on Apr. 27, 2017.

(60) Provisional application No. 62/733,507, filed on Sep. 19, 2018, provisional application No. 62/328,102, filed on Apr. 27, 2016.

(51) Int. Cl.
*B25B 13/06* (2006.01)
*B25B 15/00* (2006.01)
*B25B 13/04* (2006.01)

(52) U.S. Cl.
CPC ..... *B25B 15/001* (2013.01); *B25B 15/008* (2013.01); *B25B 23/08* (2013.01)

(58) Field of Classification Search
USPC ..... 81/53.2, 461
See application file for complete search history.

(56) References Cited

U.S. PATENT DOCUMENTS 2,570,706 A 10/1951 Peluse
2,614,418 A 10/1952 Shaff
3,405,377 A 10/1968 Pierce
3,495,485 A 2/1970 Knudsen et al.
3,902,384 A 9/1975 Ehrler
3,908,489 A 9/1975 Yamamoto et al.
3,972,252 A 8/1976 Hunter
4,474,089 A 10/1984 Scott
4,536,115 A * 8/1985 Helderman ..... B25B 27/143 411/17
4,893,530 A 1/1990 Warheit
4,927,020 A 5/1990 Randy
4,930,378 A 6/1990 Colvin
4,970,922 A * 11/1990 Krivec ..... B25B 15/005 81/451
5,019,080 A 5/1991 Hemer
5,201,255 A 4/1993 Gegg
5,219,392 A 6/1993 Ruzicka et al.
5,251,521 A 10/1993 Burda et al.
5,398,823 A 3/1995 Anders
5,481,948 A 1/1996 Zerkovitz
5,501,342 A 3/1996 Geibel
5,519,929 A 5/1996 Bleckman
5,645,177 A 7/1997 Lin
5,669,516 A 9/1997 Horn
5,725,107 A 3/1998 Dembicks
5,743,394 A 4/1998 Martin
5,782,148 A 7/1998 Kerkhoven
5,802,692 A * 9/1998 Philippe ..... B25B 27/0035 29/244
5,823,702 A * 10/1998 Bynum ..... F16L 19/005 403/320
5,829,327 A 11/1998 Stanton
5,832,792 A 11/1998 Hsieh
5,960,681 A 10/1999 Anderson
6,009,778 A 1/2000 Hsieh
6,092,279 A 7/2000 Shoup
6,352,011 B1 * 3/2002 Fruhm ..... B25B 15/001 81/436
6,431,373 B1 8/2002 Blick
6,575,057 B1 6/2003 Ploeger
6,698,316 B1 * 3/2004 Wright ..... B25B 13/065 81/121.1
6,755,098 B2 6/2004 Huang
6,761,089 B2 7/2004 Bergamo
6,857,340 B2 2/2005 Wagner
6,951,156 B2 10/2005 Garg
7,000,501 B1 2/2006 Chen
D524,615 S 7/2006 Albertson
7,225,710 B2 6/2007 Pacheco
7,331,260 B2 2/2008 Cheng
7,717,278 B2 1/2010 Kao
D614,931 S 5/2010 Su
7,788,994 B2 9/2010 Wright et al.
7,841,480 B2 11/2010 Hsieh
7,913,593 B2 3/2011 Dahar et al.
8,166,851 B2 5/2012 Pchola
8,302,255 B2 11/2012 Lin
8,336,709 B1 12/2012 Geibel
D745,814 S 12/2015 Hsieh
D776,505 S 1/2017 Doroslovac
9,687,968 B2 1/2017 Doroslovac et al.
D784,106 S 4/2017 Doroslovac
D794,405 S 8/2017 Doroslovac et al.
9,718,170 B2 8/2017 Eggert et al.
D798,682 S 10/2017 Doroslovac et al.
9,873,195 B1 1/2018 Buxton
9,878,441 B1 1/2018 Kao
D829,069 S 9/2018 Doroslovac et al.
10,081,094 B2 9/2018 Doroslovac et al.
D859,944 S 9/2019 Kukucka et al.
D859,945 S 9/2019 Kukucka et al.
D859,946 S 9/2019 Kukucka et al.
D859,947 S 9/2019 Kukucka et al.
D867,841 S 11/2019 Kukucka et al.
D868,553 S 12/2019 Kukucka et al.
D879,577 S 3/2020 Kukucka et al.
D880,968 S 4/2020 Kukucka et al.
D880,977 S 4/2020 Kukucka et al.
D885,149 S 5/2020 Kukucka et al.
D887,233 S 6/2020 Kukucka et al.
D887,711 S 6/2020 Kukucka et al.
D889,224 S 7/2020 Kukucka et al.
D889,257 S 7/2020 Kukucka et al.
D892,578 S 8/2020 Kukucka et al.
10,780,556 B2 9/2020 Kukucka et al.
10,786,890 B2 9/2020 Kukucka et al.
D899,091 S 10/2020 Kukucka et al.
10,828,766 B2 11/2020 Kukucka et al.
D904,152 S 12/2020 Kukucka et al.
D906,781 S 1/2021 Kukucka et al.
10,882,162 B2 1/2021 Kukucka et al.
D909,842 S 2/2021 Kukucka et al.
D910,490 S 2/2021 Lim et al.
10,919,133 B2 2/2021 Kukucka et al.
10,967,488 B2 4/2021 Kukucka et al.
2003/0209111 A1 11/2003 Huang
2004/0256263 A1 12/2004 Shih
2005/0098459 A1 5/2005 Gorman
2005/0103664 A1 5/2005 Shih
2005/0257357 A1 11/2005 Huang
2006/0156869 A1 7/2006 Hsieh
2006/0266168 A1 * 11/2006 Pacheco, Jr. ..... B25B 15/005 81/460
2007/0261519 A1 11/2007 Cheng
2008/0235930 A1 10/2008 English
2009/0007732 A1 1/2009 Hsieh
2009/0120885 A1 5/2009 Kao
2009/0255384 A1 * 10/2009 Whitehead ..... B25B 27/0035 81/459
2011/0056339 A1 3/2011 Su
2011/0303052 A1 12/2011 Chen
2012/0060656 A1 3/2012 Chang
2013/0047798 A1 2/2013 Huang
2013/0213193 A1 * 8/2013 Lukes ..... F16B 23/003 81/436
2014/0260832 A1 9/2014 Hsiao
2014/0331826 A1 11/2014 Campbell
2014/0360321 A1 12/2014 Steinweg et al.
2015/0266169 A1 9/2015 Campbell, II
2015/0314429 A1 11/2015 Doroslovac
2016/0067853 A1 * 3/2016 Neto ..... B25B 27/18 81/53.2
2016/0089772 A1 * 3/2016 Liu ..... B25B 23/12 81/451
2016/0136792 A1 5/2016 Harp
2016/0223005 A1 8/2016 Rathmann

(56) References Cited

U.S. PATENT DOCUMENTS

| | | | |
|---|---|---|---|
| 2016/0339564 | A1 | 11/2016 | Chen |
| 2017/0282337 | A1* | 10/2017 | Johnson ..... B25B 15/008 |
| 2017/0312839 | A1 | 11/2017 | Moss et al. |
| 2018/0001450 | A1* | 1/2018 | Anderson ..... B25B 27/18 |
| 2018/0003241 | A1 | 1/2018 | Goss |
| 2018/0354022 | A1 | 12/2018 | Ross et al. |
| 2018/0354102 | A1 | 12/2018 | Kukucka et al. |
| 2019/0152033 | A1 | 5/2019 | Kukucka et al. |
| 2019/0283233 | A1 | 9/2019 | Kukucka et al. |
| 2019/0337131 | A1 | 11/2019 | Kukucka et al. |
| 2019/0375077 | A1 | 12/2019 | Kukucka et al. |
| 2020/0376648 | A1 | 12/2020 | Kukucka et al. |
| 2020/0391360 | A1 | 12/2020 | Kukucka et al. |
| 2021/0039245 | A1 | 2/2021 | Kukucka et al. |

FOREIGN PATENT DOCUMENTS

| | | | |
|---|---|---|---|
| AU | 201612721 | | 6/2016 |
| CA | 168071 | | 12/2016 |
| CA | 2898480 | A1 | 1/2017 |
| CA | 2898480 | A1 | 7/2017 |
| CA | 3022514 | A1 | 11/2017 |
| CN | 2767068 | Y | 3/2006 |
| CN | 3630254 | | 6/2006 |
| CN | 102395447 | | 3/2012 |
| CN | 303924849 | | 11/2016 |
| CN | 303956827 | | 12/2016 |
| CN | 303984883 | | 12/2016 |
| CN | 109414805 | | 3/2019 |
| DE | 10321284 | A1 | 12/2004 |
| DE | 202010006146 | U1 | 7/2010 |
| EP | 1731774 | A1 | 12/2006 |
| GB | 906839 | A | 9/1962 |
| GB | 1294764 | A | 11/1972 |
| IN | 201817044032 | | 3/2019 |
| JP | 2005-214006 | | 8/2005 |
| JP | 3119614 | | 2/2006 |
| JP | 2011143522 | | 7/2011 |
| JP | 2012157913 | | 10/2011 |
| JP | 2015180835 | A | 7/2017 |
| KR | 200149097 | Y1 | 8/1998 |
| RU | 2152870 | C1 | 7/2000 |
| RU | 2225786 | C2 | 1/2001 |
| RU | 116398 | | 5/2012 |
| RU | 180548 | U1 | 6/2018 |
| WO | WO9416862 | A1 | 8/1994 |
| WO | WO9710926 | | 3/1997 |
| WO | WO9932264 | | 7/1999 |
| WO | WO0166312 | A1 | 9/2001 |
| WO | WO2001066312 | A1 | 9/2001 |
| WO | WO2004002687 | A1 | 1/2004 |
| WO | WO2005070621 | | 8/2005 |
| WO | WO2006023374 | | 3/2006 |
| WO | WO2006130490 | A1 | 12/2006 |
| WO | WO2010007402 | A1 | 1/2010 |
| WO | DM090809 | | 4/2016 |
| WO | WO2016051080 | A1 | 4/2016 |
| WO | DM091188 | | 5/2016 |
| WO | DM091189 | | 5/2016 |
| WO | WO2017178997 | | 10/2017 |
| WO | WO2018172831 | | 9/2018 |
| WO | WO2019012486 | | 1/2019 |
| WO | WO2019167032 | | 9/2019 |
| WO | WO2019175652 | | 9/2019 |
| WO | WO2020039281 | | 2/2020 |
| WO | WO2020039285 | | 2/2020 |
| WO | WO2020058777 | | 3/2020 |
| WO | WO2020152516 | | 7/2020 |
| WO | WO2020208608 | | 10/2020 |
| WO | WO2020225800 | | 11/2020 |
| WO | WO2021001696 | | 1/2021 |
| WO | WO2021019500 | | 2/2021 |
| WO | WO2021033152 | | 2/2021 |

* cited by examiner

FASTENER EXTRACTOR DEVICE

The current application claims a priority to the U.S. Provisional Patent application Ser. No. 62/733,507 filed on Sep. 19, 2018.

FIELD OF THE INVENTION

The present invention generally relates to various tools designed for extracting or removing fasteners, in particular bolts and nuts. More specifically, the present invention discloses a combination of anti-slip threaded extractors, designed to remove damaged fasteners.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction.

One of the most common problems in using these types of fasteners, whether male or female, is the tool slipping in the head portion, or slipping on the head portion. This is generally caused by either a worn fastener or tool, corrosion, overtightening, or damage to the head portion of the fastener. Various methods may be used to remove a fastener, some more aggressive than others. Once a fastener head is damaged, a more aggressive method must be implemented to remove a seized fastener. Drilling out the fastener is a common method used by some users to dislodge the fastener. While this method can prove to be effective in some scenarios there is a high risk of damaging the internal threads of the hole. The present invention is an extractor removal system that virtually eliminates the chance of slippage. The design uses a series of integrated splines that bite into the head of the fastener and allow for efficient torque transfer between the extractor bit and the head portion of the fastener. Another common issue when using traditional bolt extractors is that material from the fastener or the actual fastener remains attached to the extractor tool. The present invention allows users to dislodge any remaining material and or the fastener from the extracting tool.

DETAIL DESCRIPTIONS OF THE INVENTION

All illustrations of the drawings are for the purpose of describing selected versions of the present invention and are not intended to limit the scope of the present invention.

The present invention generally related to extracting tools and extracting tool accessories. More specifically the present invention discloses various extractor bits, including both male and female embodiments. Removing damaged fasteners from an extractor tool can prove to be a difficult task. The present invention aims to solve this issue by disclosing a release sleeve integrated into an extractor tool, specifically designed to assist users with removing any pieces of broken fastener which may have been wedged onto the extractor tool.

Figure 1:
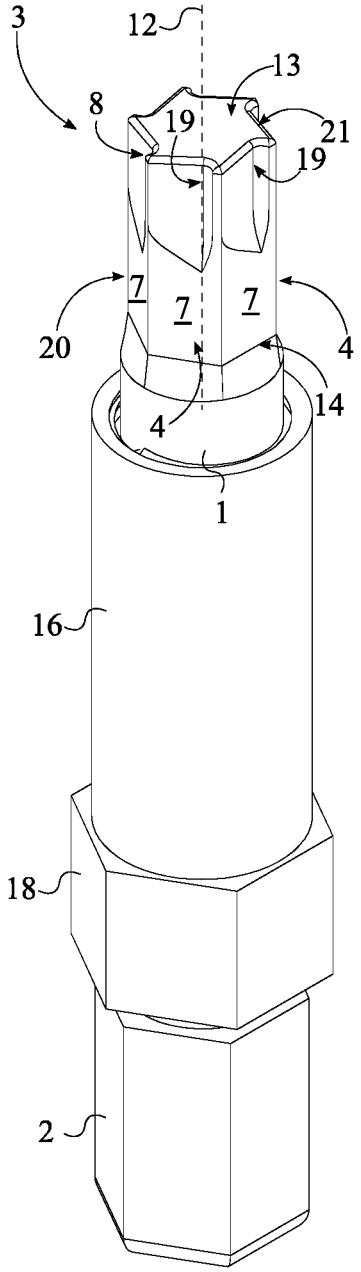
FIG. 1 is a perspective view of the present invention.
Figure 2:
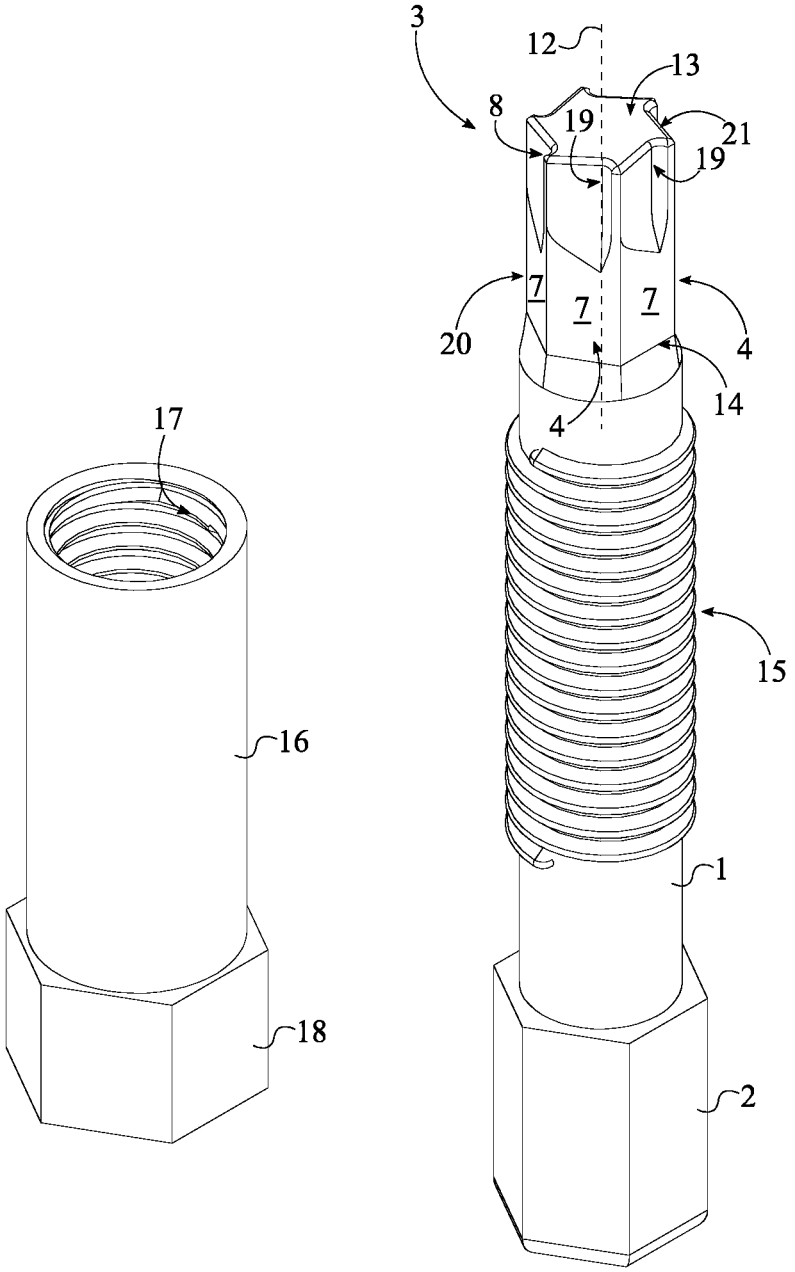
FIG. 2 is a perspective view of the present invention in an exploded state.

Referring to FIG. 1 and FIG. 2, the present invention comprises a shank body 1, a drive head 2, a torque-tool body 3, an external thread 15, a tubular sleeve 16, an internal thread 17, and a nut 18. The shank body 1 and the drive head 2 allow the present invention to be attached to an external torque tool and, thus, allow torque force to be applied to the socket fastener through the torque-tool body 3 for extraction, similar to traditional designs. External torque tools include, but are not limited to, electric drills, torque wrenches, pneumatic drills, socket screw drivers, and other similar torque tools. The drive head 2 acts as the engagement element for an external torque tool. Specifically, the drive head 2 is a nut-shaped element and is terminally and concentrically connected to the shank body 1. The preferred profile of the drive head 2 is a hexagonal profile although alternative geometries may also be utilized. For example, in one embodiment, the drive head 2 has a square profile. In another embodiment of the present invention, the bottom portion of the drive head 2 is dome-shaped. Specifically, the bottom portion is portion of the drive head 2 that is located opposite the shank body 1, across the drive head 2. The dame-shaped designed yields a striking surface where impact force is applied to forcibly insert the torque-tool body 3 into the object to be extracted. The striking surface is not limited to being dome-shaped.

Figure 3:
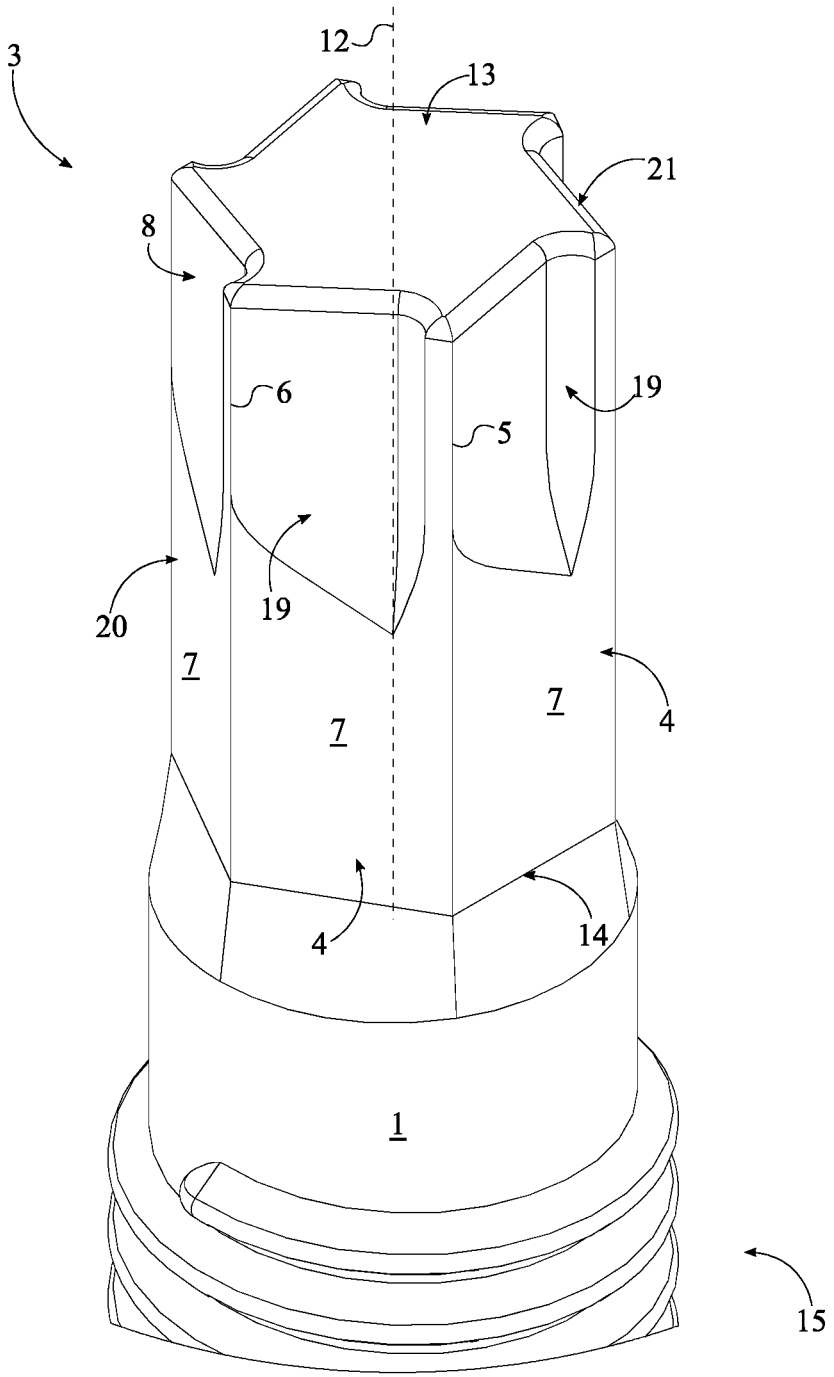
FIG. 3 is an enlarged view of a torque-tool body of the present invention.

The torque-tool body 3 is a shank which engages a seized socket fastener, such as a socket screw, a socket bolt, or into a specific sized drilled hole within a broken stud or any threaded shank in order to apply a torque force to dislodge said seized fastener. The torque-tool body 3 is positioned opposite the drive head 2, along the shank body 1. Referring to FIG. 3, the torque-tool body 3 comprises a plurality of laterally-bracing sidewalls 4, an at least one engagement feature 8, a first base 13, and a second base 14. In general, the torque-tool body 3 is a prism composed of a strong metal that is terminally and concentrically connected to the shank body 1. Each of the plurality of laterally-bracing sidewalls 4 engage within and grip a socket fastener in order to efficiently transfer torque from an external torque tool to a socket fastener. The plurality of laterally-bracing sidewalls 4 is radially positioned about a rotation axis 12 of the torque-tool body 3 to yield a geometric profile complimentary to that of a socket fastener. The number within the plurality of laterally-bracing sidewalls 4 is subject to change to compliment the shape and profile of a variety of socket fasteners. In one embodiment of the present invention, the number within the plurality of laterally-bracing sidewalls 4 is six and the resulting geometric profile of the torque-tool body 3 is a hexagon. In an alternative embodiment of the present invention, the number within the plurality of laterally-bracing sidewalls 4 is four and the resulting geometric profile of the torque-tool body 3 is a square.

The first base 13 and the second base 14 are positioned opposite to each other along the plurality of laterally-bracing sidewalls 4; wherein the shank body 1 is adjacently connected to the second base 14, opposite the first base 13. Additionally, the first base 13 and second base 14 are oriented perpendicular to each of the plurality of laterally-bracing sidewalls 4 and thus enclose/complete the prism shape of the torque-tool body 3. More specifically, it is preferred that the first base 13 comprises a first base 13 surface, wherein the first base 13 surface is flat and is oriented perpendicular to the each of the plurality of laterally-bracing sidewalls 4. It is also preferred that a lateral edge 21 between the first base 13 and each of the plurality of laterally-bracing sidewalls 4 is chamfered. Further, the first base 13 may be cone shaped to yield a point, similar to a tool punch. When impact force is applied to the drive head 2, the engagement feature 8 is designed to cut into the sidewall of the object to be removed. The engagement feature 8 increases the friction/connection between the plurality of laterally-bracing sidewalls 4 and a socket fastener to prevent relative slippage. Thus, the engagement feature 8 is integrated into a specific sidewall 20 from the plurality of laterally-bracing sidewalls 4; wherein the specific sidewall 20 denotes any from the plurality of laterally-bracing sidewalls 4.

The tubular sleeve 16 is an elongated tubular structure with an internal diameter complimentary to the external diameter of the shank body 1. The tubular sleeve 16, the internal thread 17, the external thread 15, and the nut 18 act as a dislodging mechanism for removing any excess material and or a socket fastener from the torque-tool body 3. The preferred tubular sleeve 16 design includes a diameter step-up along the tubular sleeve 16 at a first end of the tubular sleeve 16, wherein the first end of the tubular sleeve is positioned adjacent to the torque-tool body 3. This provides additional engagement surface in between the tubular sleeve 16 and the foreign object affixed to the torque-tool body 3. In general, the tubular sleeve 16 translates along the shank body 1 in order to press against a socket fastener on the torque-tool body 3 until said socket fastener, i.e. foreign object, is dislodged. Specifically, the external thread 15 extends along the shank body 1 in between the torque-tool body 3 and the drive head 2. Additionally, the external thread 15 is laterally connected to the shank body 1. The internal thread 17 is designed complimentary to the external thread 15 for an interlocking fit. The internal thread 17 is positioned within the tubular sleeve 16 and extends along the tubular sleeve 16. Additionally, the internal thread 17 laterally traverses into the tubular sleeve 16. For operation, the shank body 1 is concentrically positioned within the tubular sleeve 16 with the internal thread 17 being mechanically engaged to the external thread 15. This allows the tubular sleeve 16 to slide along the shank body 1 when the shank body 1 and the tubular sleeve 16 are spun relative to each other. After the torque-tool body 3 is used to remove a seized socket fastener, the user may need to remove the socket fastener from the torque-tool body 3. For this, the user simply spins the tubular sleeve 16 about the shank body 1 to slide the tubular sleeve 16 towards the torque-tool body 3 until the tubular sleeve 16 presses against the socket fastener to dislodge the socket fastener. Rotating the tubular sleeve 16 may be done with the user's hands, but in cases where additional leverage is necessary the user may use two external torque tools, such as wrenches. One wrench is mechanically engaged to shank body 1 through the drive head 2 and the other wrench is mechanically engaged to the tubular sleeve 16 through the nut 18. For this, the nut 18 is terminally and concentrically connected to the tubular sleeve 16. Similar to the tubular sleeve 16, the shank body 1 is also positioned within the nut 18. The preferred shaped of the nut 18 is a hex, although alternative geometries may also be used. The size, length, and material composition of the tubular sleeve 16 and the nut 18 are subject to change to meet the needs and preferences of the user.

Figure 4:
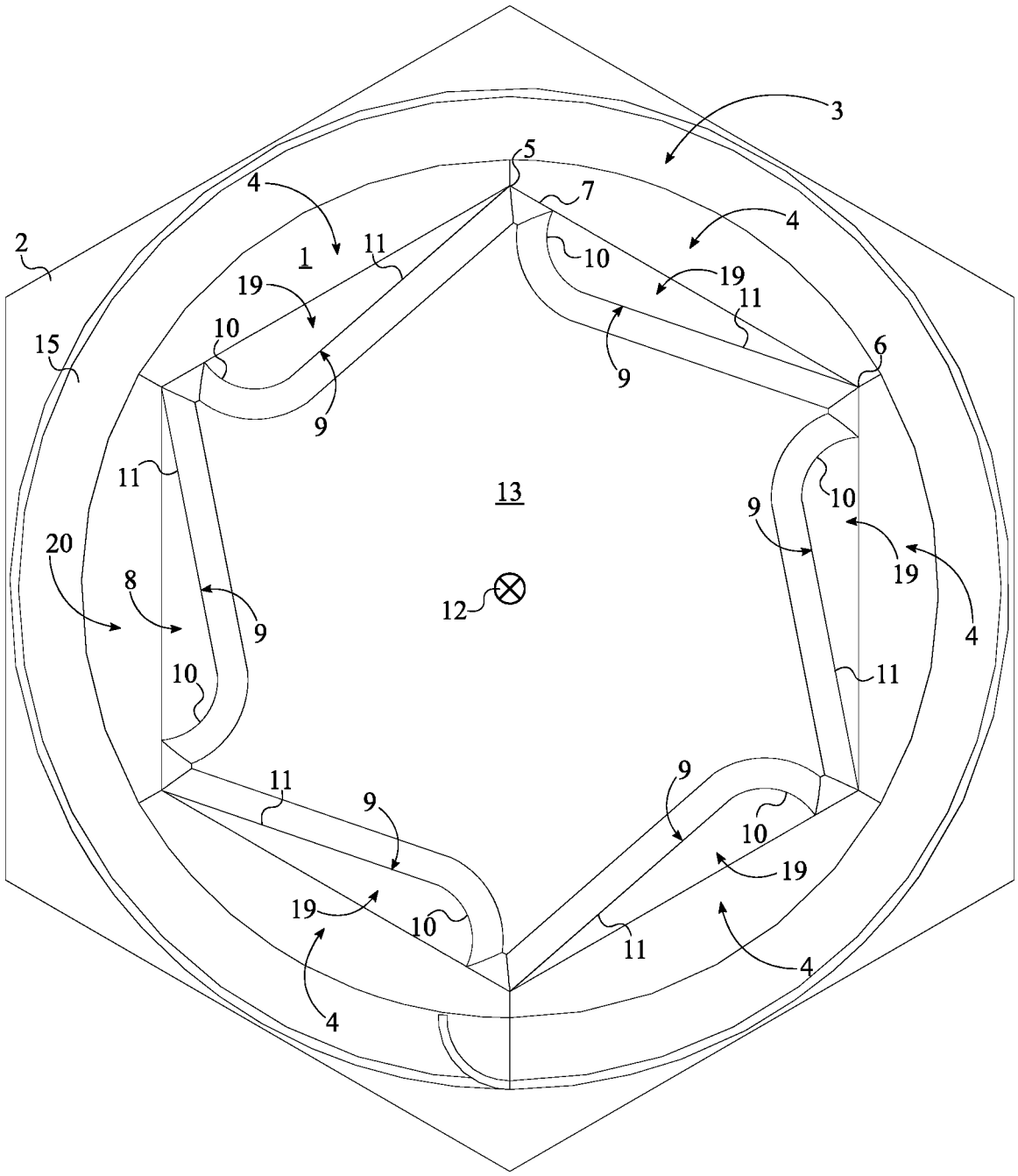
FIG. 4 is a top view of a shank body, a drive head, and the torque-tool body of the present invention.

In one embodiment of the present invention, referring to FIG. 3 and FIG. 4, the engagement feature 8 is an engagement cavity. For reference, each of the plurality of laterally-bracing sidewalls 4 comprises a first lateral edge 5, a second lateral edge 6, and a bracing surface 7. The bracing surface 7 physically presses against a socket fastener, specifically against a lateral sidewall of a head portion from the socket fastener. The first lateral edge 5 and the second lateral edge 6 are positioned opposite to each other across the bracing surface 7. When viewed from either the top perspective or the bottom perspective, the first lateral edge 5 and the second lateral edge 6 from each of the plurality of laterally-bracing sidewalls 4 make up the corners of the torque-tool body 3. The engagement cavity traverses normal and into the bracing surface 7 of the specific sidewall 20 such that a flat portion is formed on the bracing surface 7 of the specific sidewall 20 and thus creates an additional gripping point/tooth on the bracing surface 7. The gripping point is created by the engagement cavity and the bracing surface 7. In one embodiment of the present invention, the engagement cavity extends into the torque-tool body 3 from the first base 13 towards the second base 14. This ensures that the additional gripping point extends along the length of the torque-tool body 3 for maximum grip engagement. In another embodiment of the present invention, the engagement cavity tapers from the first base 13 towards the second base 14 as seen in FIG. 3. To further ensure maximum grip engagement, it is preferred that an entire cross-section 9 of the engagement cavity is oriented parallel to the first base 13 and the second base 14.

In one embodiment of the present invention, the entire cross-section 9 of the engagement cavity is a partially-circular profile. Additionally, the partially-circular profile is concave along a direction from the first lateral edge 5 of the specific sidewall 20 to the second lateral edge 6 of the specific sidewall 20. The partially-circular profile ensures that there are little to no high stress points in the torque-tool body 3, thus increasing the overall longevity of the tool. In a separate embodiment of the present invention, the entire cross-section 9 of the engagement cavity is a triangular profile. Additionally, the triangular profile is concave along a direction from the first lateral edge 5 of the specific sidewall 20 to the second lateral edge 6 of the specific sidewall 20. Alternative profiles may be used for the engagement cavity including, but not limited to, a semi-square profile, a semi-rectangular profile, and a semi-oval profile. It is preferred that the internal corners of triangular, square, semi square type profiles have a radius for additional strength.

Referring to FIG. 4, in one embodiment of the present invention, the entire cross-section 9 of the engagement cavity comprises a curved portion 10 and a straight portion 11. The resulting gripping point is uniquely shaped in order to form a sharp engagement tooth that digs into a corner(s) of the socket fastener, allowing material from the internal sides of the fastener socket into the engagement cavity and thus yielding a superior grip over traditional tools which are simply designed to push material away. This is especially true for worn or damaged fastener sockets. The curved portion 10 is a partially circular curve that is positioned adjacent to the first lateral edge 5 of the specific sidewall 20. The straight position is positioned adjacent to the curved portion 10, opposite the first lateral edge 5 of the specific sidewall 20. The straight portion 11 guides a portion of the socket fastener to press against the formed engagement tooth. As such, the straight portion 11 extends from the curved portion 10 to the second lateral edge 6 of the specific sidewall 20. Specifically, the straight portion 11 starts at the curved portion 10 and ends at the second lateral edge 6 of the specific sidewall 20. This embodiment may be implemented in a clock-wise configuration or a counter clock-wise configuration by flipping the positioning of the curved portion 10 with the straight portion 11. Additionally, referring to FIGS. 3-4, a length of the flat portion is less than a length of the at least one engagement cavity, and a width of the flat portion extending along the rotation axis 12 is equal to a width of the at least one engagement cavity extending along the rotation axis 12.

In another embodiment of the present invention, the engagement cavity is centrally position on the bracing surface 7 of the specific sidewall 20. In particular, the engagement cavity is positioned offset from the first lateral edge 5 of the specific sidewall 20 by a first distance and offset from the second lateral edge 6 of the specific sidewall 20 by a second distance; wherein the first distance equals the second distance. In an alternative embodiment, the first distance may not be equal to the second distance. This positions the engagement cavity to engage the internal lateral sidewall of the socket fastener for the most efficient transfer of torque with the least possibility of slippage. Additionally, this embodiment may be used to rotate the socket fastener in either the clockwise or the counter-clockwise direction.

Figure 5:
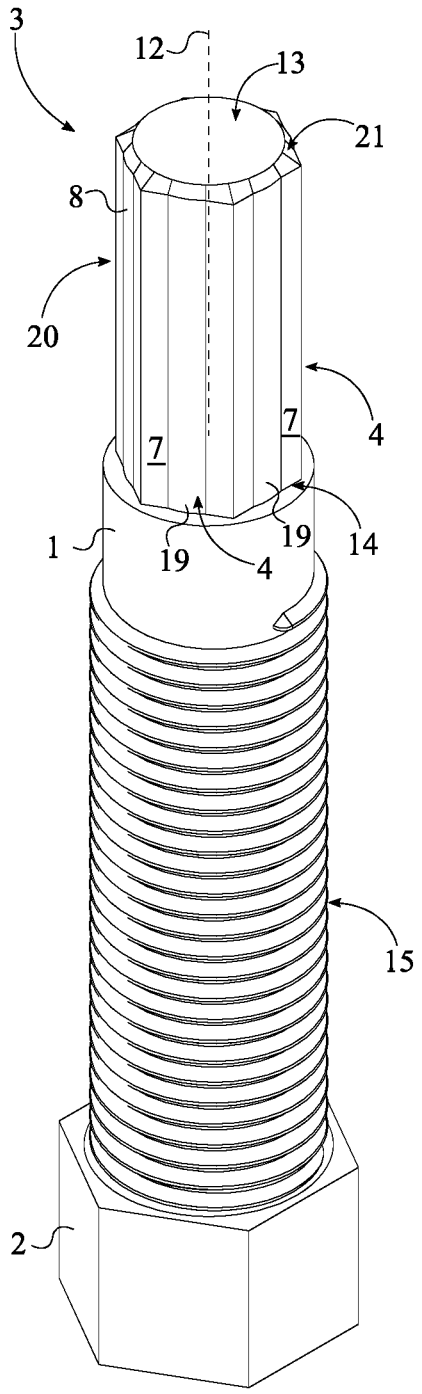
FIG. 5 is a perspective view of an alternative embodiment of the present invention, depicting the shank body, the drive head, and the torque-tool body.
Figure 6:
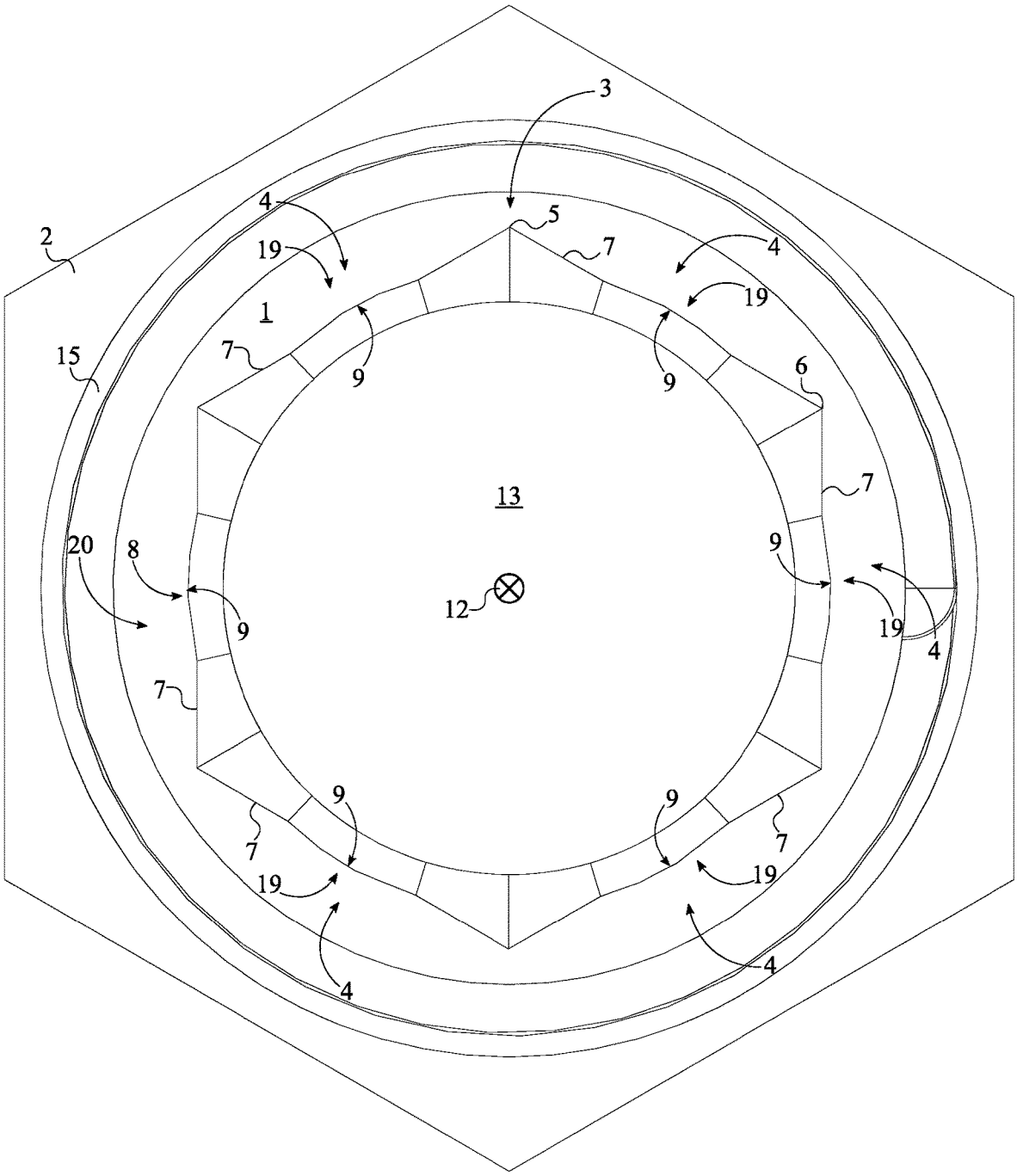
FIG. 6 is a top view of the shank body, the drive head, and the torque-tool body of the alternative embodiment of the present invention.
Figure 7:
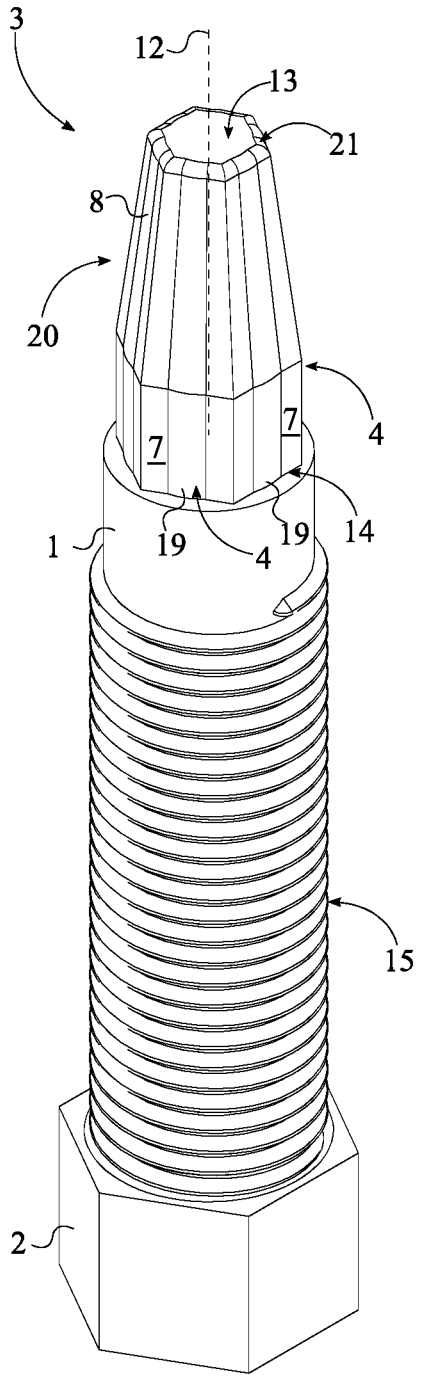
FIG. 7 is a perspective view of an alternative embodiment of the present invention, depicting the shank body, the drive head, and the torque-tool body.

Referring to FIG. 5, FIG. 6, and FIG. 7, in one embodiment of the present invention, the engagement feature 8 is an engagement protrusion. The engagement protrusion is material extruding from the torque-tool body 3 that creates an additional gripping element to the specific sidewall 20. Specifically, the engagement protrusion is laterally connected to the bracing surface 7 of the specific sidewall 20. Additionally, the engagement protrusion extends from the first base 13 to the second base 14 to ensure the additional gripping element extends along the length of the torque-tool body 3 and allows the present invention to engage the socket fastener at an increased depth, thus maximizing the torque applied to the socket fastener. Furthermore, it is preferred that the engagement protrusion is centrally positioned in between the first lateral edge 5 of the specific sidewall 20 and the second lateral edge 6 of the specific sidewall 20 to allow for this embodiment to be used as a clock-wise and counter clock-wise tool. To ensure consistent grip along the torque-tool body 3, an entire cross-section 19 of the engagement protrusion is parallel to the first base 13 and the second base 14.

Referring to FIG. 6, in one embodiment of the present invention, the entire cross-section 19 of the engagement protrusion is a partially-circular profile. Specifically, the partially circular profile of the engagement protrusion is convex along a direction from the first lateral edge 5 of the specific sidewall 20 to the second lateral edge 6 of the specific sidewall 20. This is especially useful for extremely worn and stripped socket fasteners as the tool-receiving cavity of the socket fastener enlarges when worn or stripped. The engagement protrusion extends out of the bracing surface 7 of the specific sidewall 20 to press against and engage the worn sides of the socket fastener.

Referring to FIG. 4 and FIG. 6 in the preferred embodiment of the present invention, the at least one engagement feature 8 comprises a plurality of engagement features 8. For this, the plurality of engagement features 8 is radially positioned about the rotation axis 12 with each of the plurality of engagement features 8 being integrated into a corresponding sidewall from the plurality of laterally-bracing sidewalls 4 as seen in FIG. 3. This configuration yields an additional gripping features on each of the plurality of laterally bracing sidewalls that ensure that a significant grip is created in between the present invention and a socket fastener.

Referring to FIG. 7, in one embodiment of the present invention, the torque-tool body 3 is tapered from the second base 14 towards the first base 13. This allows the present invention to be used on socket fasteners of different sizes. The degree of taper is subject to change to meet the needs and preferences of the user. In one embodiment of the present invention, the torque-tool body 3 may be connected to various implements including, but not limited to, impact tools, hydraulic screws, wrench sockets, and screwdrivers.

Figure 8:
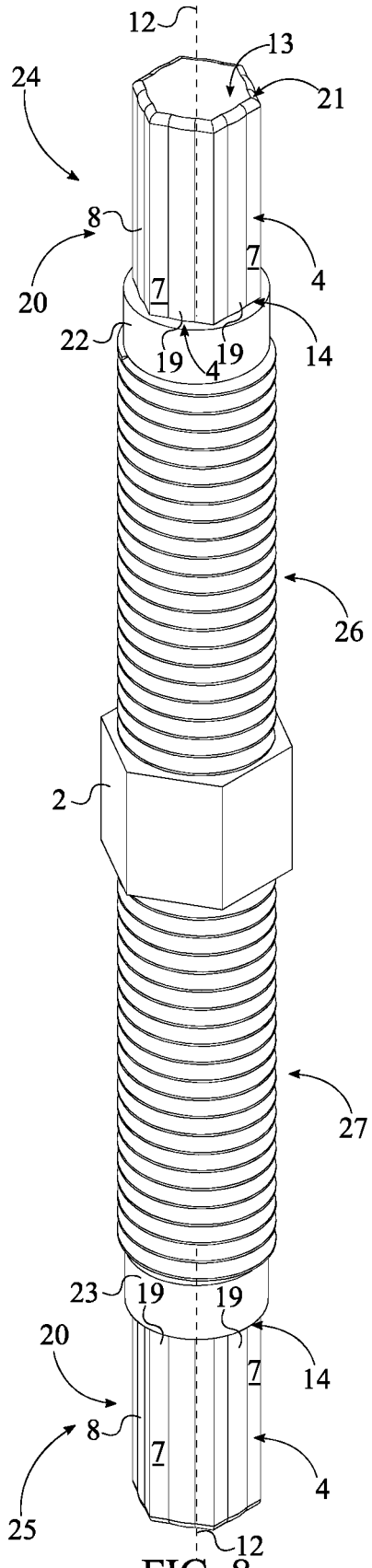
FIG. 8 is a perspective view of an alternative embodiment of the present invention.

In one embodiment, referring to FIG. 8, the present invention is implemented in a double-ended configuration. In this embodiment, the at least one shank body 1 comprises a first shank body 22 and a second shank body 23; the at least one torque-tool body 3 comprises a first torque-tool body 24 and a second torque-tool body 25; and the at least one external thread 15 comprises a first external thread 26 and a second external thread 27. This embodiment provides a dual sided version for the present invention, wherein the two sides may be differently designed and or oriented for increased versatility; specifically, this allows the present invention to be utilized for clockwise rotation and counter-clockwise rotation. The first shank body 22 and the second shank body 23 are positioned opposite to each other across the drive head 2. The first torque-tool body 24 is terminally and concentrically connected to the first shank body 22, opposite the drive head 2. The first external thread 26 extends along the first shank body 22, in between the first torque-tool body 24 and the drive head 2; additionally, the first external thread 26 is laterally connected to the first shank body 22. This outlines a single engagement side of the present invention. Mirroring this, the second torque-tool body 25 is terminally and concentrically connected to the second shank body 23, opposite the drive head 2. The second external thread 27 extends along the second shank body 23, in between the second torque-tool body 25 and the drive head 2; additionally, the second external thread 27 is laterally connected to the second shank body 23. In this embodiment, the type of engagement feature(s) of the first torque-tool body may vary from the type of engagement feature(s) of the second torque-tool body to yield a two-in-one tool.

Although the invention has been explained in relation to its preferred embodiment, it is to be understood that many other possible modifications and variations can be made without departing from the spirit and scope of the invention as hereinafter claimed.

What is claimed is:

1. A fastener extractor device comprising:

at least one shank body;

at least one torque-tool body;

the torque-tool body comprising a plurality of laterally-bracing sidewalls and at least one engagement feature;

the plurality of laterally-bracing sidewalls being radially positioned about a rotation axis of the torque-tool body;

the at least one engagement feature being integrated into a specific sidewall among the plurality of laterally-bracing sidewalls;

the torque-tool body being terminally and concentrically connected to the shank body;

the at least one engagement feature being an engagement cavity;

each of the plurality of laterally-bracing sidewalls comprising a first lateral edge, a second lateral edge and a bracing surface, the bracing surface being flat, the first lateral edge and the second lateral edge being positioned opposite to each other across the bracing surface;

the at least one engagement cavity partially traversing normal and into the bracing surface of the specific sidewall such that a flat portion is formed on the bracing surface of the specific sidewall and such that at least one engagement tooth is formed on the bracing surface of the specific sidewall;

an entire cross-section of the at least one engagement cavity comprising a curved portion and a straight portion;

the curved portion being positioned adjacent to the first lateral edge of the specific sidewall;

the straight portion being positioned adjacent to the curved portion, opposite the first lateral edge of the specific sidewall;

the straight portion extending from the curved portion to the second lateral edge of the specific sidewall;

a length of the flat portion being less than a length of the at least one engagement cavity; and a width of the flat portion extending along the rotation axis being equal to a width of the at least one engagement cavity extending along the rotation axis.

2. The fastener extractor device as claimed in claim 1 comprising:

the at least one engagement feature comprises a plurality of engagement features;

the plurality of engagement features being radially positioned about the rotation axis of the torque-tool body; and each of the plurality of engagement features being integrated into a corresponding sidewall from the plurality of laterally-bracing sidewalls.

3. The fastener extractor device as claimed in claim 1 comprising:

the torque-tool body comprising a first base and a second base;

the first base and the second base each being oriented perpendicular to each of the plurality of laterally-bracing sidewalls;

the shank body being adjacently connected to the second base, opposite to the first base.

4. The fastener extractor device as claimed in claim 3, wherein the entire cross-section of the engagement cavity is parallel to the first base and the second base.

5. The fastener extractor device as claimed in claim 3, wherein a lateral edge between the first base and each of the plurality of laterally-bracing sidewalls is chamfered.

6. The fastener extractor device as claimed in claim 1 comprising:

the torque-tool body further comprises a first base and a second base;

the shank body being adjacently connected to the second base, opposite to the first base; and the torque-tool body tapering from the second base towards the first base.

7. The fastener extractor device as claimed in claim 1 comprising:

a drive head;

the drive head being terminally and concentrically connected to the shank body;

the torque-tool body being positioned opposite to the drive head, along the shank body;

at least one external thread;

the external thread extending along the shank body, in between the torque-tool body and the drive head; and the external thread being laterally connected to the shank body.

8. The fastener extractor device as claimed in claim 7 comprising:

a tubular sleeve;

an internal thread;

the internal thread being positioned within the tubular sleeve;

the internal thread extending along the tubular sleeve;

the internal thread traversing into the tubular sleeve;

the shank body being concentrically positioned within the tubular sleeve; and the internal thread being mechanically engaged to the external thread.

9. The fastener extractor device as claimed in claim 8 comprising:

a nut;

the nut being terminally and concentrically connected to the tubular sleeve; and the shank body being positioned within the nut.

10. The fastener extractor device as claimed in claim 7 comprising:

the at least one shank body comprising a first shank body and a second shank body;

the at least one torque-tool body comprises a first torque-tool body and a second torque-tool body;

the first shank body and the second shank body being positioned opposite to each other across the drive head;

the first torque-tool body being terminally and concentrically connected to the first shank body, opposite the drive head; and the second torque-tool body being terminally and concentrically connected to the second shank body, opposite the drive head.

11. The fastener extractor device as claimed in claim 10 comprising:

the at least one external thread comprises a first external thread and a second external thread;

the first external thread extending along the first shank body, in between the first torque-tool body and the drive head;

the first external thread being laterally connected to the first shank body;

the second torque-tool body being terminally and concentrically connected to the second shank body, opposite the drive head;

the second external thread extending along the second shank body, in between the second torque-tool body and the drive head; and the second external thread being laterally connected to the second shank body.

12. The fastener extractor device as claimed in claim 1 comprising:

the engagement cavity traversing normal and into a portion of the bracing surface of the specific sidewall without traversing into a remaining portion of the bracing surface of the specific sidewall;

the remaining portion of the bracing surface of the specific sidewall being flat; and an arc length of the curved portion being larger than a length of the remaining portion of the bracing surface of the specific sidewall and less than a length of the straight portion.

* * * * *